US009495833B2

(12) United States Patent
Gomes

(10) Patent No.: US 9,495,833 B2
(45) Date of Patent: Nov. 15, 2016

(54) ELECTRONIC GAMING SYSTEM WITH SINGLE ACTION, MULTIPLE-PLAY USING RESIDUAL VALUE AMOUNTS

(71) Applicant: Gabriel Thomas Gomes, Las Vegas, NV (US)

(72) Inventor: Gabriel Thomas Gomes, Las Vegas, NV (US)

( * ) Notice: Subject to any disclaimer, the term of this patent is extended or adjusted under 35 U.S.C. 154(b) by 272 days.

(21) Appl. No.: 14/286,883

(22) Filed: May 23, 2014

(65) Prior Publication Data

US 2015/0141121 A1 May 21, 2015

Related U.S. Application Data

(60) Provisional application No. 61/904,945, filed on Nov. 15, 2013.

(51) Int. Cl.
*A63F 9/00* (2006.01)
*G07F 17/32* (2006.01)

(52) U.S. Cl.
CPC ..... *G07F 17/3248* (2013.01)

(58) Field of Classification Search
None
See application file for complete search history.

(56) References Cited

U.S. PATENT DOCUMENTS 6,612,574 B1 * 9/2003 Cole ..... G07F 17/3244 273/138.1
7,059,965 B2 * 6/2006 Jackson ..... G07F 17/3293 273/292
7,241,221 B1 * 7/2007 Luciano, Jr. ..... G07F 17/32 463/20
7,322,885 B1 * 1/2008 Luciano, Jr. ..... G07F 17/32 273/138.1
8,419,526 B1 * 4/2013 Cannon ..... G07F 17/32 463/25
2002/0068620 A1 * 6/2002 Stern ..... A63F 3/0645 463/13
2002/0142816 A1 * 10/2002 Stronach ..... G06Q 50/34 463/6
2003/0157979 A1 * 8/2003 Cannon ..... G07F 17/42 463/16
2003/0171145 A1 * 9/2003 Rowe ..... G06Q 20/02 463/25
2003/0216170 A1 * 11/2003 Walker ..... G07F 17/32 463/25
2004/0229677 A1 * 11/2004 Gray ..... G07F 17/32 463/17
2006/0160624 A1 * 7/2006 Slomiany ..... G07F 17/32 463/42
2007/0010311 A1 * 1/2007 Irwin ..... A63F 3/064 463/17
2007/0117604 A1 * 5/2007 Hill ..... G07F 17/32 463/16
2007/0129137 A1 * 6/2007 Walker ..... G07F 17/32 463/25
2007/0275777 A1 * 11/2007 Walker ..... G07F 17/3227 463/16
2008/0026822 A1 * 1/2008 Walker ..... G07F 17/32 463/25
2008/0119284 A1 * 5/2008 Luciano ..... G07F 17/3244 463/42
2008/0268938 A1 * 10/2008 Doutriaux ..... G07F 1/06 463/17
2009/0137312 A1 * 5/2009 Walker ..... G07F 17/32 463/25
2010/0267438 A1 * 10/2010 Williams ..... G07F 17/32 463/17
2012/0302312 A1 * 11/2012 Katz ..... G07F 17/329 463/17
2013/0203482 A1 * 8/2013 Singer ..... G07F 17/3244 463/25
2013/0217459 A1 * 8/2013 Luciano, Jr. ..... G07F 17/3255 463/16
2015/0339888 A1 * 11/2015 Hong ..... G07F 17/3239 463/25
2016/0012668 A1 * 1/2016 Karpe ..... G07F 17/329 463/17

* cited by examiner

*Primary Examiner* — Seng H Lim
(74) *Attorney, Agent, or Firm* — Mark A. Litman & Associates, P.A.

(57) ABSTRACT

A gaming method is played on a gaming system having a processor. The processor executes code to:

a) receive a ticket-in-ticket-out wager from the player input system, the ticket having a wagering value;
b) dedicate the entire wagering value to a single gaming event on the electronic gaming system;
c) the gaming system providing a random gaming event outcome identified by the processor;
d) compare the random gaming event outcome and resolving the wager according to a high volatility paytable; and
e) awarding any winning outcome from the resolution of the wager as a ticket without providing a credit on the gaming machine that is available for future wagering on the gaming machine.

11 Claims, 4 Drawing Sheets

ELECTRONIC GAMING SYSTEM WITH SINGLE ACTION, MULTIPLE-PLAY USING RESIDUAL VALUE AMOUNTS

RELATED APPLICATION DATA

This Application claims priority from U.S. Provisional Application Ser. No. 61/904,945 filed 15 Nov. 2013.

BACKGROUND OF THE INVENTION

1. Field of the Invention

The present invention relates to the field of gaming, especially electronic gaming in which small wagers on tickets are used in a single round of play in a high volatility electronic gaming system.

2. Background of the Art

Games of chance have been enjoyed by people for thousands of years and have enjoyed increased and widespread popularity in recent times. As with most forms of entertainment, players enjoy playing a wide variety of games and new games. Playing new games adds to the excitement of "gaming." As is well known in the art and as used herein, the term "gaming" and "gaming devices" are used to indicate that some form of wagering is involved, and that players must make wagers of value, whether actual currency or some equivalent of value, e.g., token or credit.

One popular game of chance is the slot machine. Conventionally, a slot machine is configured for a player to wager something of value, e.g., currency, house token, established credit or other representation of currency or credit. After the wager has been made, the player activates the slot machine to cause a random event to occur. The player wagers that particular random events will occur that will return value to the player. A standard device causes a plurality of reels to spin and ultimately stop, displaying a random combination of some form of indicia, for example, numbers or symbols. If this display contains one of a preselected plurality of winning combinations, the machine releases money into a payout chute or increments a credit meter by the amount won by the player. For example, if a player initially wagered two coins of a specific denomination and that player achieved a payout, that player may receive the same number or multiples of the wager amount in coins of the same denomination as wagered.

There are many different formats for generating the random display of events that can occur to determine payouts in wagering devices. The standard or original format was the use of three reels with symbols distributed over the face of the wheel. When the three reels were spun, they would eventually each stop in turn, displaying a combination of three symbols (e.g., with three wheels and the use of a single payout line as a row in the middle of the area where the symbols are displayed. By appropriately distributing and varying the symbols on each of the reels, the random occurrence of predetermined winning combinations can be provided in mathematically predetermined probabilities. By clearly providing for specific probabilities for each of the preselected winning outcomes, precise odds that would control the amount of the payout for any particular combination and the percentage return on wagers for the house could be readily controlled.

Other formats of gaming apparatus that have developed in a progression from the pure slot machine with three reels have dramatically increased with the development of video gaming apparatus. Rather than have only mechanical elements such as wheels or reels that turn and stop to randomly display symbols, video gaming apparatus and the rapidly increasing sophistication in hardware and software have enabled an explosion of new and exciting gaming apparatus. The earlier video apparatus merely imitated or simulated the mechanical slot games in the belief that players would want to play only the same games. Early video games therefore were simulated slot machines. The use of video gaming apparatus to play new games such as draw poker and Keno broke the ground for the realization that there were many untapped formats for gaming apparatus. Now casinos may have hundreds of different types of gaming apparatus with an equal number of significant differences in play. The apparatus may vary from traditional three reel slot machines with a single payout line, video simulations of three reel video slot machines, to five reel, five column simulated slot machines with a choice of twenty or more distinct paylines, including randomly placed lines, scatter pays, or single image payouts. In addition to the variation in formats for the play of games, bonus plays, bonus awards, and progressive jackpots have been introduced with great success.

The volatility of a game is based upon a comparison of the frequency of winning events as compared to the size of odds or payouts on the winning events. A low volatility game is one in which there are frequent, lows odds payouts or winning events (with the house still having a retention of 1-8% on the game). For example, video blackjack is a low volatility game, where most winning outcomes are paid at 1:1 (blackjack being an exception at 3:2) and the house still has a 1-3% advantage, depending upon the skill of the player. A high volatility game would have infrequent winning outcomes, but the odds paid on winning events would be relatively high. Some side bets, progressive jackpot bets and the like fall into this category.

Casinos are looking for ways to make games more exciting and to find additional sources of revenue. The amount of money wagered is not necessarily as critical to the casinos as compared to the amount of money on individual wagers collectively retained by the casinos. The proliferation of penny video game machines, with large numbers of paylines and up to 20 units wagered per payline has spurred a significant growth in revenues for casinos.

One avenue in sources of income/revenue for casinos that has not yet been explored is marginal or small ticket values used for unique gaming modalities. The present invention enables and discloses novel game play tied to small value wagering based on tickets provided from various sources.

SUMMARY OF THE INVENTION

A gaming method is played on a gaming system having a processor. The processor executes code to:

a) receive a ticket-in-ticket-out wager from the player input system, the ticket having a wagering value;
b) dedicate the entire wagering value to a single gaming event on the electronic gaming system;
c) the gaming system providing a random gaming event outcome identified by the processor;
d) compare the random gaming event outcome and resolving the wager according to a high volatility paytable; and
e) awarding any winning outcome from the resolution of the wager as a ticket without providing a credit on the gaming machine that is available for future wagering on the gaming machine.

DETAILED DESCRIPTION OF THE INVENTION

Figure 1:
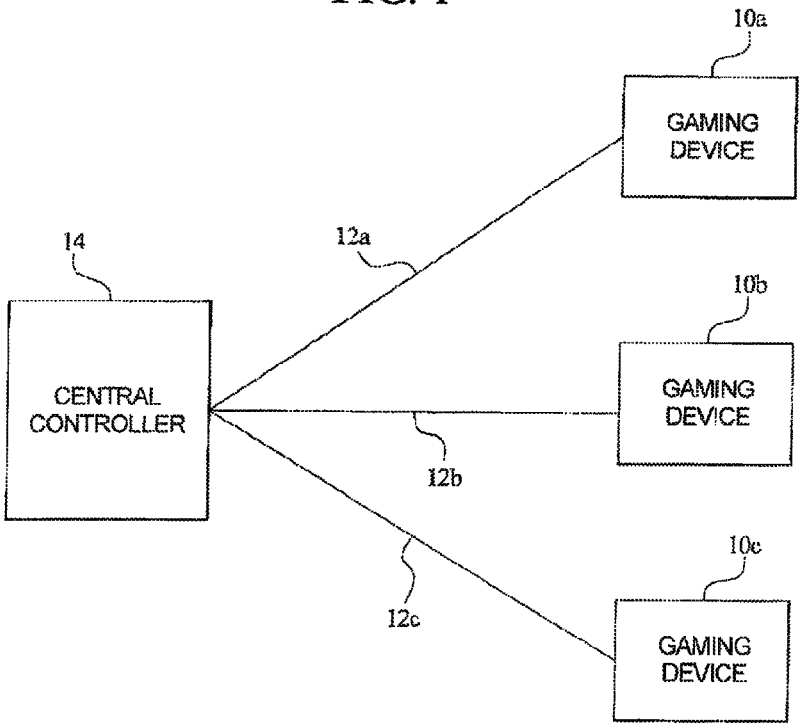
FIG. 1 is a schematic of a game system of the present invention.

A gaming method is played on a gaming system having a processor. The processor executes code to:

a) receive a ticket-in-ticket-out wager from the player input system, the ticket having a wagering value;
b) dedicate the entire wagering value to a single gaming event on the electronic gaming system;
c) the gaming system providing a random gaming event outcome identified by the processor;
d) compare the random gaming event outcome and resolving the wager according to a high volatility paytable; and
e) awarding any winning outcome from the resolution of the wager as a ticket without providing a credit on the gaming machine that is available for future wagering on the gaming machine.

It will be readily apparent that the various methods and algorithms described herein may be implemented by, e.g., appropriately programmed general purpose computers and computing devices. Typically a processor (e.g., one or more microprocessors) will receive instructions from a memory or like device, and execute those instructions, thereby performing one or more processes defined by those instructions. Further, programs that implement such methods and algorithms may be stored and transmitted using a variety of media (e.g., computer readable media) in a number of manners. In some embodiments, hard-wired circuitry or custom hardware may be used in place of, or in combination with, software instructions for implementation of the processes of various embodiments. Thus, embodiments are not limited to any specific combination of hardware and software A "processor" means any one or more microprocessors, CPU devices, computing devices, microcontrollers, digital signal processors, or like devices.

The term "computer-readable medium" refers to any medium that participates in providing data (e.g., instructions) that may be read by a computer, a processor or a like device. Such a medium may take many forms, including but not limited to, non-volatile media, volatile media, and transmission media. Non-volatile media include, for example, optical or magnetic disks and other persistent memory. Volatile media include DRAM, which typically constitutes the main memory. Transmission media include coaxial cables, copper wire and fiber optics, including the wires that comprise a system bus coupled to the processor. Transmission media may include or convey acoustic waves, light waves and electromagnetic emissions, such as those generated during RF and IR data communications. Common forms of computer-readable media include, for example, a floppy disk, a flexible disk, hard disk, magnetic tape, any other magnetic medium, a CD-ROM, DVD, any other optical medium, punch cards, paper tape, any other physical medium with patterns of holes, a RAM, a PROM, an EPROM, a FLASH-EEPROM, any other memory chip or cartridge, a carrier wave as described hereinafter, or any other medium from which a computer can read.

Various forms of computer readable media may be involved in carrying sequences of instructions to a processor. For example, sequences of instruction (i) may be delivered from RAM to a processor, (ii) may be carried over a wireless transmission medium, and/or (iii) may be formatted according to numerous formats, standards or protocols, such as Bluetooth™, TDMA, CDMA, 3G, 4G.

Where databases are described, it will be understood by one of ordinary skill in the art that (i) alternative database structures to those described may be readily employed, and (ii) other memory structures besides databases may be readily employed. Any illustrations or descriptions of any sample databases presented herein are illustrative arrangements for stored representations of information. Any number of other arrangements may be employed besides those suggested by, e.g., tables illustrated in drawings or elsewhere. Similarly, any illustrated entries of the databases represent exemplary information only; one of ordinary skill in the art will understand that the number and content of the entries can be different from those described herein. Further, despite any depiction of the databases as tables, other formats (including relational databases, object-based models and/or distributed databases) could be used to store and manipulate the data types described herein. Likewise, object methods or behaviors of a database can be used to implement various processes, such as the described herein. In addition, the databases may, in a known manner, be stored locally or remotely from a device that accesses data in such a database.

Some embodiments can be configured to work in a network environment including a computer that is in communication, via a communications network, with one or more devices. The computer may communicate with the devices directly or indirectly, via a wired or wireless medium such as the Internet, LAN, WAN or Ethernet, Token Ring, or via any appropriate communications means or combination of communications means. Each of the devices may comprise computers, such as those based on the Intel® Pentium® or Centrino™ processor, that are adapted to communicate with the computer. Any number and type of machines may be in communication with the computer. The present disclosure provides, to one of ordinary skill in the art, an enabling description of several embodiments and/or inventions. Some of these embodiments and/or inventions may not be claimed in the present application, but may nevertheless be claimed in one or more continuing applications that claim the benefit of priority of the present application. Applicants intend to file additional applications to pursue patents for subject matter that has been disclosed and enabled but not claimed in the present disclosure.

Figure 2A:
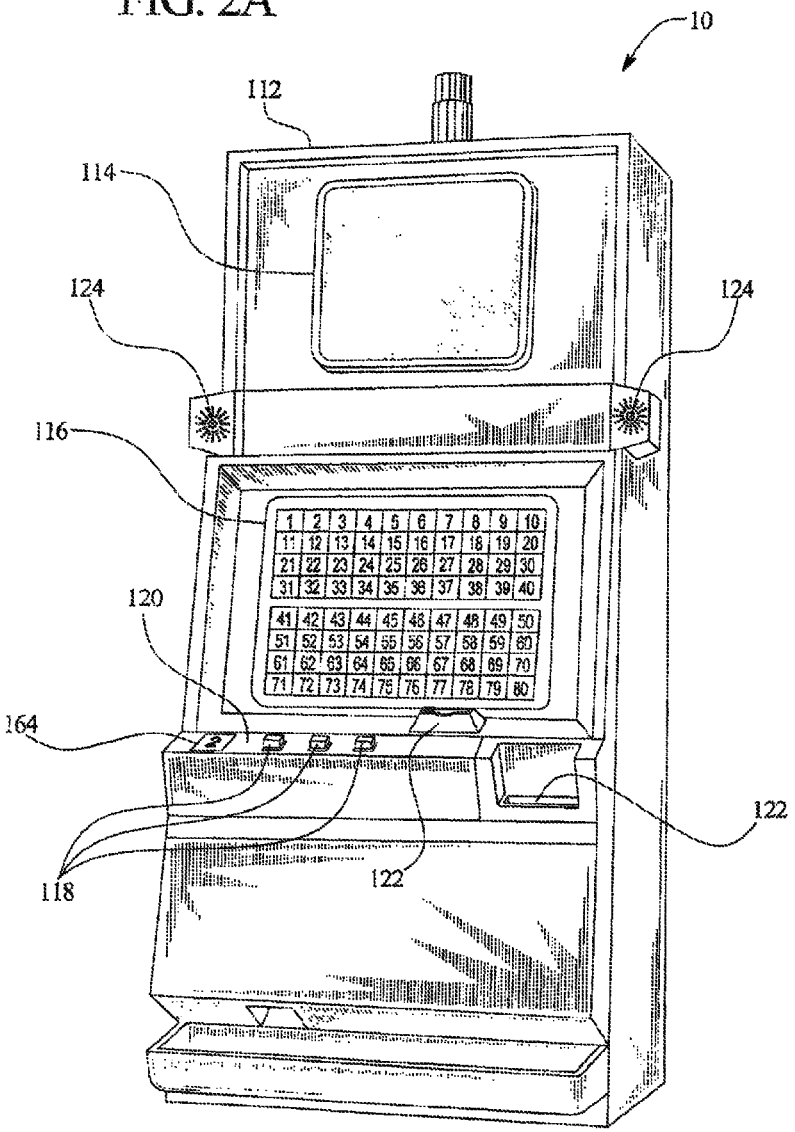
FIG. 2A shows a wagering terminal useful in the present invention.
Figure 2B:
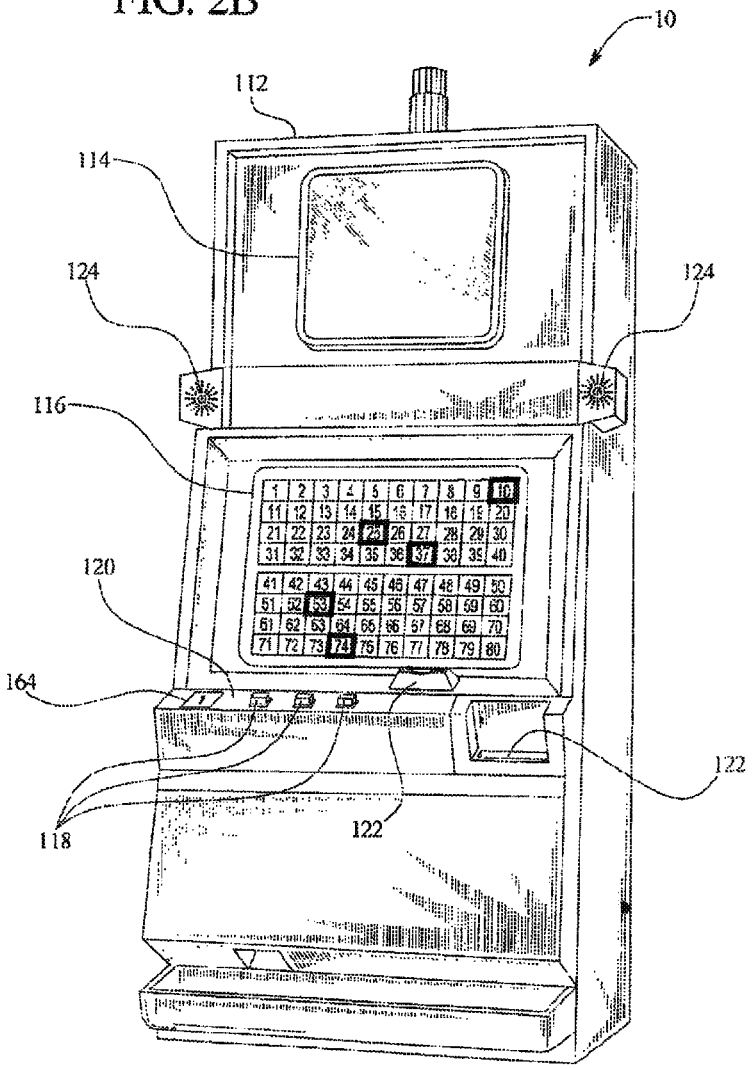
FIG. 2B shows a wagering terminal with a look of a keno screen useful in the practice of the present invention, which format can provide a high volatility event.

Referring now to FIGS. 2A and 2B, each of the embodiments described herein is provided in one preferred embodiment in a gaming terminal 10. Alternatively, the embodiments are provided on various monitors throughout a casino or gaming establishment, including traditional display boards and electronic terminals and video gaming equipment. Gaming terminal 10 is in one embodiment a video gaming device and includes a cabinet 112 having at least one video monitor. The illustrated embodiment includes two video monitors 114 and 116. Cabinet 112 is illustrated as being of a type where the player stands or sits. The cabinet is alternatively a bar top cabinet, wherein the player sits to play the symbol matching game of the present invention.

The cabinet 112 also provides controls for a player to operate gaming terminal 10. In the illustrated embodiment, various electromechanical input devices 118 are provided on a tilted portion 120 of the cabinet 112, below video monitors 114 and 116. Electromechanical input devices 118 each send a discrete signal to a microprocessor located within cabinet 112. These input devices enable the player to perform the various gaming functions, including but not limited to, selecting at least one of the active numbers or game choices, playing multiple games at once, wagering a number of credits per game and cashing out. The input devices 118 may also enable the player to play multiple animal/number-selection games in a row.

Similar to the electromechanical input devices 118, cabinet 112 of gaming terminal 10 can provide electromechanical displays that show, for example, the player's credits maintained within gaming terminal 10, the number of animal associated numbers played, the bet per game, etc. In one preferred embodiment, however, these functions as well as others are provided on one or more video monitor or display devices 114 and 116. In one embodiment, display device 114 may show the pays for a number of hits or matches between the numbers or game choices that the player selects and the numbers or game choices that gaming terminal 10 marks or illuminates. Displays 114 and 116 can also inform the player of the rules concerning the operation of the symbol selection and symbol matching game of the present invention.

Video monitors 114 and 116 display, among other items: (i) the selected numbers or symbols numbers or game choices generated by the gaming terminal 10 based on the game outcome seed; (ii) the modified symbol numbers or game choices; (iii) the numbers played by the player; (iv) the wager per game; (v) the player's total wager and (vi) the player's symbol award, if any. In one embodiment, credit display 164 displays the player's accumulated credits. In one embodiment, when the player selects a number or game choice, gaming terminal 10 highlights it as a certain color, for example, yellow. When the gaming device generates a number or game choice or uses the bidirectional map to modify a number or game choice, gaming terminal 10 highlights it as a different color, for example, blue. When a match occurs, the number is highlighted by a third color, for example, green, a combination of blue and yellow.

Cabinet 112 of gaming terminal 10 also includes one or more monetary input devices 122. The monetary input device 122 can accept coins, cash, a smart card, a credit card, a debit card, a casino card, ticket-in/ticket out wagering/accounting systems or other type of gaming device card. The gaming terminal 10 can also include a ticket reader and a ticket printer (not illustrated) that enables the player to input and receive a redeemable ticket in lieu of cash. The ticket reader/validator and printer operate with a processor housed inside gaming terminal 10.

Figure 3:
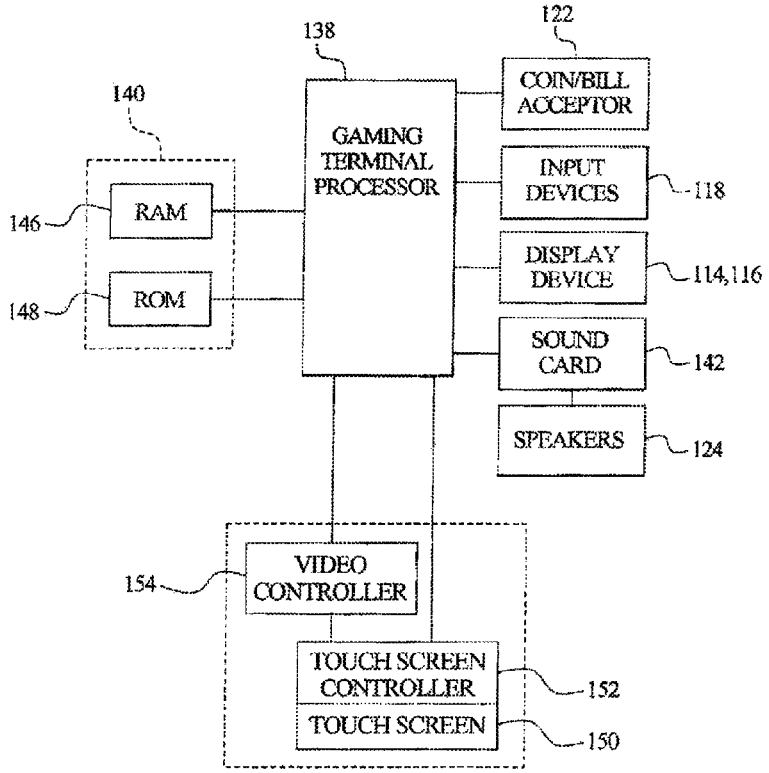
FIG. 3 shows a schematic of a system useful in the present invention.

Referring now to FIG. 3, gaming terminal 10 is run by a processor or central processing unit ("CPU") 138 and a memory device 140 that operates with one or more display devices 114 and 116 that display the generated animal numbers. Processor 138 can be a microprocessor and have a microcontroller-based platform. The processor 138 is operable with a communication device which is in communication with the central controller. The memory device 140 includes random access memory ("RAM") 146 and read only memory ("ROM") 148. The platform for the processor 138 and memory device 140 can be: (i) inside gaming terminal 10; or (ii) as stand alone components in the casino, part of a server/client system, data network, one or more application-specific integrated circuits (ASIC's), field programmable gated arrays (FPGA's) or one or more hard-wired devices. Furthermore, although the processor 138 and memory device 140 preferably reside on each gaming terminal 10 unit, it is possible to provide at least the function of selecting a game outcome seed (that is deterministic of a game outcome) from a pool or set of game outcome seeds, at a central location by a central controller such as a network server for communication to a playing station such as over a local area network (LAN), wide area network (WAN), Internet connection, microwave link, and the like.

Cabinet 112 of gaming terminal 10 also provides a number of speakers 124 that operate via a soundcard 142 with processor 138 to inform the player of any type of output, outcome or instruction of gaming terminal 10.

Gaming terminal 10 provides an electromechanical input device 18 or simulated input device provided by a touch screen 150 that operates via a touch screen controller 152 and a video controller 154 with the processor 138. The input devices enable the player to operate the gaming terminal 10 of the present invention. One of the video monitors 114 and 116 and possibly, additionally the speakers 124 are used to explain: (i) when . . . ; (ii) how many . . . ; (iii) how much; and (iv) the type of award provided for obtaining the required number of matches.

In addition to winning base game credits, the gaming terminal 10, including any of the base games disclosed above, also includes secondary or bonus games that give players the opportunity to win credits. The gaming terminal 10 preferably employs a video-based display device 130 or 132 for the secondary or bonus games. The secondary or bonus games include a program that automatically begins when the player achieves a qualifying condition or a secondary game triggering outcome in the base game, such as a certain number of matches, a specific number matched or any other suitable triggering event.

The game play of the game of the present invention is initiated by a player inserting the appropriate amount of money or tokens at one of the plurality of gaming terminals in communication with the central controller as indicated in block 202. The gaming terminal enables the player to push one of the electromechanical pushbuttons or touch the touch screen that operates with the display device to select one or more numbers or game choices to play from a plurality of different player selectable numbers or game choices as indicated in block 204. It should be appreciated that while numbers are used to describe the present invention, any other suitable game choice such as symbols, images or indicia may be implemented with the game of the present invention.

Ticket-in, ticket-out (TITO) is a technology used in more modern slot machines. A typical TITO slot machine prints out a bar code printed slip of paper, which can then either be redeemed for cash, or inserted for play into other TITO machines.

Ticket-in, ticket out (TITO) machines are used in casino slot machines to print out a slip of paper with a barcode indicating the amount of money represented. These can in turn be redeemed for cash at an automated kiosk. The machines utilize a bar code scanner or other reading system for the visually or mechanically readable information on the ticket built into the bill acceptor, or in the case usually a ticket only acceptor. A ticket printer in place of a coin hopper (some rare machines are set up to pay with coins if the payout is less than the payout limit, and to print a ticket in situations where a handpay would normally be required) and a network interface to communicate with a central system that tracks tickets.

The present technology may be generally described as both a gaming system and a gaming method. The electronic gaming system may have:

a processor;

a video display system;

a ticket-in-ticket-out receiver accepting value for wagering on the gaming system;

a player input system; and communication links between the player input system and the processor, and the processor and the video display system;

wherein the processor is configured to execute code that enables a process of:

a) receiving a ticket-in-ticket-out wager from the player input system;

b) applying the entire value of the received ticket-in-ticket-out wager to a single game event on the electronic wagering system;

c) the processor executing code to randomly provide a random gaming event outcome;

d) the processor comparing the random gaming event outcome provided to a paytable and resolving the wager according to a paytable;

wherein the resolving of the ticket-in-ticket-out wager is against a high volatility paytable where the lowest odds are at least 10:1 for any winning event. The gaming system may have the processor is configured to allow only a single game event to be played off the ticket and any winning event payout is immediately paid on a new ticket-in-ticket-out ticket and is not retained a credit on the gaming apparatus. The system and method of play are hoped to be used for "residual" value tickets from ticket-in-ticket-out systems.

For example, the ticket wagering values may be a partial payment from a separate gaming machine (e.g., where there is a payout of $35.75, the machine may issue tickets of $30 and $5.75, or more likely $35.00 and $0.75, with the $0.75 ticket being the ticket wager acceptable for the system of the present technology). The processor may be configured to allow ticket values o only one dollar or less on the play, with a gaming machine dedicated to the single gaming event, single ticket play.

By single gaming event it is meant that there is one single play on the machine, not necessarily (although that is an option) that the total amount of the ticket is a wager on a single outcome. That event could be, for example, where there is a very high volatility payout of 10,000:1 available, so that a single event wager of a total amount of $0.99 would pay back $9,990.00. Other winning events o 50:1 and 100:1 and 1,000:1 might also be available. A preferred method, which would possibly stimulate greater use of the machine and system, is where the individual units (e.g., each penny of the $0.75, or seventy-five units) would be separately used as a contemporaneous or sequential wager. For example, if there were seventy-five units available, the processor could play seventy-five randomly created wagers with 10-picks on each wager, and payout on only winning combinations of at least 7 or 8 numbers. This would create a very high volatility paytable, and the machine could make a single game draw against the 75 tables, and issue any winning ticket accordingly. The processor could alternatively play 75 simultaneous poker hands and pay only for four-of-a-kind or better, and pay 10,000:1 for only Royal flushes in which the cards are ordered from highest to lowest in the natural selection (left to right) in the random outcome. Any other format of playing high volatility video games or wagering games with the ticket-in-ticket out ticket being applied in a single event can be provided, such as hitting at least three high value paylines in a multiline (e.g., 15 line) 3×5 format on a video display.

The gaming system may have or require the processor to prevent the new ticket-in-ticket-out ticket from being accepted by the gaming apparatus until at least a second ticket-in-ticket-out ticket has been received by the gaming apparatus to repeat the process of a), b), c) and d) or the processor prevents the new ticket-in-ticket-out ticket from being accepted by the gaming apparatus. The high volatility paytable may have lowest odds that are at least 50:1 for any winning event, at least 75:1 for any winning event, at least 100:1 for any winning event, or even higher, such as 250:1, 500:1 or 1000:1.

The gaming system may be configured to allow only a single game event to be played off the ticket and any winning event payout is immediately paid on a new ticket-in-ticket-out ticket and is not retained a credit on the gaming apparatus or the processor prevents the new ticket-in-ticket-out ticket from being accepted by the gaming apparatus until at least a second ticket-in-ticket-out ticket has been received by the gaming apparatus to repeat the process of a), b), c) and d).

A gaming method played on an electronic gaming system having a processor, a video display system, a player input system; and communication links between the player input system and the processor, and the processor and the video display system may have;

the processor executes code to:

a) receive a ticket-in-ticket-out wager from the player input system, the ticket having a wagering value;

b) dedicate the entire wagering value to a single gaming event on the electronic gaming system;

c) the gaming system providing a random gaming event outcome identified by the processor;

d) compare the random gaming event outcome and resolving the wager according to a paytable;

e) awarding any winning outcome from the resolution of the wager as a ticket without providing a credit on the gaming machine that is available for future wagering on the gaming machine.

The gaming method may have the ticket for the ticket-in-ticket-out wager as a gratuity ticket and not a payout from a gaming apparatus. In this mode, the casino or affiliated shops or restaurants may gift residual value type tickets for use in the single play events of the gaming system. These residual tickets may be, for example, flat ticket amounts randomly provided or a percentage of a payment to a facility. Thus, one may enter a featured restaurant at the casino and the player is awarded a ticket/group or ticket per user that has a random value on it. Alternatively, at the end of the meal, or at the end of a shopping event, the payer will receive a random value ticket or receive a value proportional to the amount spent (e.g., 0.25%, 0.50%, 0.75% or 1% of the paid price). Casinos and affiliated shops or restaurants may also choose to give customers the option to receive their change in the form of gratuity tickets for use in the single play events of the gaming system, thus retaining much needed funds while also providing the customer with a small thrill.

What is claimed:

1. An electronic gaming system comprising:

a processor;

a video display system;

a ticket-in-ticket-out receiver accepting value for wagering on the gaming system;

a player input system; and communication links between the player input system and the processor, and the processor and the video display system;

wherein the processor is configured to execute code that enables a process of:

a) receiving a ticket-in-ticket-out wager from the player input system;

b) applying the entire value of the received ticket-in-ticket-out wager to a single game event on the electronic wagering system;

c) the processor executing code to randomly provide a random gaming event outcome;

d) the processor comparing the random gaming event outcome provided to a paytable and resolving the wager according to a paytable;

wherein the resolving of the ticket-in-ticket-out wager is against a high volatility paytable where the lowest odds are at least 10:1 for any winning event further wherein the processor is configured to allow only a single game event to be played off the ticket and any winning event payout is immediately paid on a new ticket-in-ticket-out ticket and is not retained a credit on the gaming apparatus, and wherein processor prevents the new ticket-in-ticket-out ticket from being accepted by the gaming apparatus until at least a second ticket-in-ticket-out ticket has been received by the gaming apparatus to repeat the process of a), b), c) and d).

2. The gaming system of claim 1 wherein the high volatility paytable has lowest odds that are at least 50:1 for any winning event.

3. The gaming system of claim 2 wherein the processor is configured to allow only a single game event to be played off the ticket and any winning event payout is immediately paid on a new ticket-in-ticket-out ticket and is not retained a credit on the gaming apparatus and wherein processor prevents the new ticket-in-ticket-out ticket from being accepted by the gaming apparatus until at least a second ticket-in-ticket-out ticket has been received by the gaming apparatus to repeat the process of a), b), c) and d).

4. The gaming system of claim 1 wherein the high volatility paytable has lowest odds that are at least 100:1 for any winning event.

5. The gaming system of claim 1 wherein payments to the player are issued in multiple ticket-in-ticket-out tickets.

6. A gaming system according to claim 1 wherein payments to the player are made in single or multiple ticket-in-ticket-out tickets of which one or more tickets is restricted to play on a second gaming system.

7. An electronic gaming system comprising:

a processor;

a video display system;

a ticket-in-ticket-out receiver accepting value for wagering on the gaming system;

a player input system; and communication links between the player input system and the processor, and the processor and the video display system;

wherein the processor is configured to execute code that enables a process of:

a) receiving a ticket-in-ticket-out wager from the player input system;

b) applying the entire value of the received ticket-in-ticket-out wager to a single game event on the electronic wagering system;

c) the processor executing code to randomly provide a random gaming event outcome;

d) the processor comparing the random gaming event outcome provided to a paytable and resolving the wager according to a paytable;

wherein the resolving of the ticket-in-ticket-out wager is against a high volatility paytable where the lowest odds are at least 10:1 for any winning event;

further wherein the processor is configured to allow only a single game event to be played off the ticket and any winning event payout is immediately paid on a new ticket-in-ticket-out ticket and is not retained a credit on the gaming apparatus and wherein processor prevents the new ticket-in-ticket-out ticket from being accepted by the gaming apparatus.

8. The gaming system of claim 7 wherein the high volatility paytable has lowest odds that are at least 75:1 for any winning event.

9. A gaming system according to claim 7 wherein payments to the player are issued in multiple ticket-in-ticket-out tickets.

10. A gaming system according to claim 7 wherein payments to the player are issued in multiple ticket-in-ticket-out tickets.

11. A gaming system according to claim 7 wherein payments to the player are made in single or multiple ticket-in-ticket-out tickets of which one or more tickets is restricted to play on a second gaming system.

* * * * *